United States Patent [19]

Smith, Jr.

[11] Patent Number: 4,865,906

[45] Date of Patent: Sep. 12, 1989

[54] FLAME RETARDANT YARD BLEND

[76] Inventor: W. Novis Smith, Jr., 412 So. Perth St., Philadelphia, Pa. 19147

[21] Appl. No.: 146,847

[22] Filed: Jan. 22, 1988

[51] Int. Cl.[4] ..... D03D 3/00

[52] U.S. Cl. ..... 428/224; 139/420 A; 139/426 R; 139/427; 428/225; 428/373; 428/374; 428/921

[58] Field of Search ..... 428/224, 225, 373, 374, 428/921; 19/246; 57/243, 252, 255, 256; 139/420 A, 426 R, 427

[56] References Cited

U.S. PATENT DOCUMENTS 3,067,471 12/1962 Noda ..... 19/243

3,176,351 4/1965 Keen ..... 19/243

4,365,655 12/1982 Feinberg ..... 139/426

*Primary Examiner*—Marion C. McCamish

*Attorney, Agent, or Firm*—Steel, Gould & Fried

[57] ABSTRACT

An abrasion and fine resistant permanent press fabric or fabric structure comprising a batting or yarn consisting of an intimate blend of oxidized polyacrylonitrile and at least two fibers selected from the group consisting of polyvinyl halide, polybenzimidazole, p-aramid, m-aramid, fire resistant polyester and fire resistant rayon, said oxidized polyacrylonitrile comprising about 25 to 85% by weight of said yarn and p-aramid comprises less than 35% by weight of said yarn or batting.

9 Claims, No Drawings

FLAME RETARDANT YARD BLEND

FIELD OF THE INVENTION

The present invention relates to an abrasion and fire resistant permanent press fabric and fabric structures. More particularly, the invention is concerned with fabrics and fabric structures formed from yarns comprising an intimate blend of oxidized polyacrylonitrile with at least two other synthetic fibers which results in a synergistic effect with respect to fire resistance and still has good hand.

BACKGROUND OF THE INVENTION

There is a continuing need to improve the flame, heat and flash protection of pilots, firefighters, steelworkers, and the like. This is particularly critical for personnel who are frequently at close quarters when heat, flame and flash hazards occur. The primary line of protection is the fabric in the protective clothing worn by the individual. It is also important that this clothing feel comfortable and look good in order that it will be worn all the time that the individual would be at risk.

The currently used protective m and p-aramid fabrics can melt and cling to the skin during severe heat or flame excursion. Although polybenzimidazole (PBI) is a significant improvement over the aramid fibers, it still will slightly shrink and pull and is extremely expensive. The Navy Clothing and Textile Research Center has found that oxidized polyacrylonitrile fiber (OPF) offers the best heat, flame and flash protection of any textile fiber currently available. It is a good insulator, does not melt and can withstand temperatures up to 5500° F. briefly without catastrophic failure.

However, OPF has one major disadvantage; the 100% fabrics made from this material are susceptible to abrasion. This lack of the necessary amount of abrasion resistance has prevented its use in military protective clothing.

Inherently, flame-retardant fibers are well-known to those skilled in the art. These fibers, known as matrix fibers, though useful because of their flame-retardant qualities, are not strong enough to form their own fabrics, tend to have a non-uniform composition, are not succeptible of being easily dyed, and, in general, are not alone suitable for production into piece goods from which finished products, like clothing, are formed. On the other hand, conventional natural and synthetic fibers (staple fibers) which are alone suitable for production into finished piece goods, are not inherently flame-retardant.

One known attempted solution to the problem of producing an inherently flame-retardant fabric has been to blend matrix and staple fibers in various proportions. However, conventional techniques for producing blended staple yarns such as disclosed in U.S. Pat. Nos. 3,067,471 and 3,176,351 have not been successfully employed to produce a flame-retardant composite yarn, as far as is known.

Another method for producing untreated flame-retardant fabrics comprise the steps of separately blowing and carding bundles of matrix and staple fibers and then combining the sliver formed during a common drawing step to produce a blended sliver having desired proportions of matrix and staple fibers. Yet another method of producing untreated flame-retardant fabrics, and the subject of the present invention, is to produce a woven fabric having the desired flame-retardant characteristics.

It is not sufficient that the fabric merely be flame resistant and possess abrasion resistance. To be completely acceptable, the fabric must also be lightweight, conformable, nonscratchy, durable in normal use, dyeable, etc. in order that the garment made therefrom will be sufficiently comfortable and aesthetically attractive.

"Intimate blend" means that the individual staple components are not preferentially segregated within any particular region of the blend, beyond the normal fluctuation in distribution expected on a purely statistical basis. The blend may be in the form of a bale, a sliver, a yarn, a nonwoven, woven, or knitted fabric, etc. The fabrics are preferably "lightweight", i.e., have a basis weight of 3–10 oz/yd$^2$. Intimate blends of the required proportions of the desired staple components may be prepared by various conventional textile blending techniques, e.g., cofeeding tows of fibers to a staple cutter; opening and air-mixing staple bales; combining slivers of staple prior to drafting, etc.

SUMMARY OF THE INVENTION

In accordance with the invention, it has been surprisingly discovered that fire resistant permanent pressed fabrics and fabric structures can be provided from battings or yarns containing an intimate blend of oxidized polyacrylonitrile fibers with at least two other staple synthetic fibers wherein the oxidized polyacrylonitrile fibers are present in an amount of about 25 to 85% by weight, preferably 30–70% by weight.

The polyacrylonitrile fibers are advantageously blended with two or more of the following synthetic fibers: polyvinyl halide (preferably polyvinyl chloride), Kevlar, Nomex, fire resistant polyester, fire resistant rayon and polybenzamidazole.

A preferred blend of fibers comprises about 30–75% by weight of oxidized polyacrylonitrile, about 0–35% by weight of p-aramid, about 10–35% by weight m-aramid, about 10–35% by weight polybenzimidazole and about 5–25% by weight of polyvinyl chloride.

Kevlar and Nomex are both tradenames of aramid fibers available from E. I. du Pont de Nemours & Co., Wilmington, Del. Polybenzimidazole, known as P.B.I. fibers is available from Celanese Corporation of Chatham, N.J.

If desired, the blend may also include wool, preferably, fire resistant wool, to provide a still better hand.

Crimped or non-linear fibers provide loft and improved thermal insulation. The non-linear fibers provide a porosity which inhibits the spread of fire. One or more of the fibers may be non-linear.

The blend in the form of yarn is suitable for use in the fabrication of lightweight garments, uniforms, shirts, bedding, curtains, etc. The garments afford protection against brief exposures to thermal fluxes and flame. Also encompassed is yarn from such blend and fabrics woven therefrom.

"Intimate blend" means that the individual staple components are not preferentially segregated within any particular region of the blend, beyond the normal fluctuation is expected on a purely statistical basis. The blend may be in the form of a batting, bale, a sliver, a yarn, woven or knitted fabric, etc. Intimate blends of the required proportions may be prepared by various conventional textile blending techniques, e.g. cofeeding of fibers to a staple cutter, opening and air mixing staple bales, combining slivers of staple fibers prior to drafting, etc.

It is therefore an object of the invention to provide an abrasion and fire resistant permanent press fabric.

It is a further object of the invention to a fabric structure comprising a flame resistant synergistic blend of oxidized polyacrylonitrile fibers with two or more synthetic fibers.

It is a yet still further object of the invention to provide a fabric having good hand and flame resistant characteristics.

DETAILED DESCRIPTION OF THE INVENTION

In accordance with the invention, it has been surprisingly found that a fabric or fabric structure comprising a batting or yarn consisting of an intimate blend of oxidized polyacrylonitrile and at least two fibers selected from the group consisting of polyvinyl halide, polybenzimidazole, p-aramid, m-aramid, fire resistant polyester and fire resistant rayon. The oxidized polyacrylonitrile preferably comprises 25 to 85% by weight of the yarn. The addition of the aramid fibers provides abrasion resistance to the fabric. However, it is preferable not to add more than 35% by weight of p-aramid fibers since more than 35% affects the handle. The addition of fire resistant wool improves the handle of the fabric and helps to offset the lose of feel which may have occurred with the p-aramid fibers.

In accordance with one embodiment of the invention, the oxidized polyacrylonitrile fibers are opened and is then blended with either the synthetic fiber alone or together with wool to form a mixture. Although the relative amounts of oxidized polyacrylonitrile fibers and other fibers may be varied over substantially broad limits, it has been found that at least 30% by weight of oxidized polyacrylonitrile fibers must be employed in order to achieve the flame retarding characteristics of the material of the invention.

The blend of oxidized polyacrylonitrile fibers and other fibers may be then formed into a carded web employing conventional carding equipment which is well known to persons of ordinary skill in the art. The carding operation serves to uniformly blend the carbonaceous fibers and other staple fibers. The carded web will ordinarily have a thickness in the range of up to 2 inches (5.0 cm), but may be built-up in multiple plies to produce a web having a thickness of one inch or more depending upon the desired end use of the material.

The blend of fibers may be utilized in order to form fabrics having fire retarding characteristics. For example, a blend of fibers of the invention may be utilized in yarns to manufacture fire retardant articles such as clothing, blankets, sheets, and the like because of the excellent washability and shape retaining quality.

Blended staple yarns of the present invention may be, for example, 10% by weight p-aramid, 10% by weight polyvinyl chloride and 10% by weight polybenzamidazole are made by feeding a mixture of fibers of the invention with 70% oxidized polyacrylonitrile fiber. The fibers are first opened on a standard opening line and the fibers of the invention are added before the mixture is carded in a grannular card. During carding some fibers may be lost, hence the blend ratio obtained may be somewhat lower than that in the feed stock.

The carded slivers are then blended and drawn on a pin-drafter attenuated while the linear density of the drawn sliver is maintained at the level of the carded sliver.

The carded sliver is then converted into a roving on a standard roving frame. The roving is given a nominal amount of twist. The blended yarn is spun on a modified long staple ring spinning frame to a count of $15^5$ English Cotton Count (about 60 tex) with a twist multiplier of 3.

The blended yarn may be woven into a medium weight plain woven fabric on an ordinary loom. It may also be knitted into a medium weight single jersey circular knit fabric on a FAK knitting machine.

Exemplary of the products which can be structures of the present invention are set forth in the following examples. It is understood that the percentages referred to herein relate to percent by weight.

EXAMPLE 1

A. Battings were made by blending an appropriate weight percent of each respective opened fiber in a blender/feed section of a sample size 12" Rando Webber Model B manufactured by Pando Machine Corp. of Macedon, N.Y. The battings produced typically were 1 inch (2.54 cm) thick and had bulk densities in a range of from 0.4 to 6 lb/cc ft (6.4 cm to 96 kg/ccm$^3$). The battings were thermally bonded by passing the Rando batting on a conveyor belt through a thermal bonding oven at a temperature of about 300° C. together with a low melting fire resistant polyester. The result was a fire resistant non-woven fabric which could be utilized for preparing disposable uniforms.

EXAMPLE 2

Non-Flammability Test

The non-flammability of the fabric of the invention has been determined following the test procedure set forth in 14 CFR 25.853(b), which is herewith incorporated by reference. The test was performed as follows:

A minimum of three 1"×6"×12" (2.54 cm×15.24 cm×30.48 cm) specimens comprised of 35% by weight of oxidized polyacrylonitrile-30% polyvinyl chloride-30% polyvinyl chloride-5% fire resistant wool were conditioned by maintaining the specimens in a conditioning room maintained at 70 degrees ±5 degrees F. temperature and 50% ±5% relative humidity for 24 hours preceding the test.

Each specimen was supported vertically and exposed to a Bunsen or Turill burner with a nominal I.D. Tube adjusted to give a flame of 1½ inches (3.18 cm) in height by a calibrated thermocouple pyrometer in the center of the flame was 1550 degrees F. The lower edge of the specimen was ¾ inch (1.19 cm) above the top edge of the burner. The flame was applied to the center line of the lower edge of the specimens for 12 seconds and then removed.

Pursuant to the test, the material was self-extinguishing. The average burn length did not exceed 8 includes (20.32 cm). The average after flame did not exceed 15 seconds and there were no flame drippings.

EXAMPLE 3

The following fabrics were prepared and tested. For consistency and clarity the knits were omitted and only the wovens compared. Of the woven samples not all tests were run on each sample. In some cases this was because preliminary results were judged unsatisfactory (for example, burn tests on blends of 90 OPF/10 Aramid were deemed unacceptable because of yarn finish causing excessive flaming). In other cases one test was not considered mandatory (i.e., the abrasive resistance (AR) difference between plain weave and twill was tested but the flame test was not performed.)

In Table I fibers blends of yarns are listed with a number and one or two letter abbreviation for the fiber. The number refers to the percentage of fiber within the blend. The following abbreviations are used for the fibers.

O: OFF
A: m-Aramid
K: p-Aramid (KEVLAR)
P: PBI
PE: Polyester
W: Fire Resistant Wool
VC: Polyvinyl Chloride
FV: Fire Resistant Viscose.

Fire resistant (FR) rank as found by afterflame times rated according to char length.

I—best
II—very good
III—good.

The abrasion resistance that was performed using ASTM Standard D 1175 (inflated diaphram method—4 lb. air pressure with 1 lb. abrasive pressure).

The abrasion resistant ranking is made of the fabrics in decreasing order of their abrasion resistance properties. The rankings are achieved by calculating an Abrasion Resistant Factor (AR Factor). The AR Factor is calculated by dividing the average number of abrasive cycles by the weight of the fabric in oz/yd$^2$.

many types of fabrics and permitted definite conclusions to be drawn.

All of the fabrics of the invention had an abrasion (AR) factor better than cotton chambray except for one. Twenty-one of the fabrics had abrasion resistance at least two-thirds of that of a Navy wool fabric. The three knit fabrics showed equivalent pilling to cotton fabrics. The best blending fibers for abrasion resistance are Kevlar (p-aramid) and wool. However Kevlar increases the difficulties of cut and sew (makeup) and causes a poorer hand, appearance and color properties. Wool decreases the good hand somewhat, but it also hurts fire properties considerably. PBI made excellent fabrics as a blend but did not greatly increase abrasion resistance itself. Small amounts of PBI are beneficial, but it adds significantly to the cost of the fabrics. In combination with other abrasion resistant fibers, fibers such as Nomex (m-aramid) (p-aramid), Kevlar, PBI, wool and even PVC permitted lower levels of the more abrasion prone OPF while still maintaining top FR (Fire Resistant) properties.

In fact the total of OPF plus PBI can be 70–90% for optimum fire resistance while improving abrasion if at least 15% aramide is present. Other fibers such as FR viscose and polyester did not help much with respect to abrasion resistance.

The optimum level of OFF for abrasion resistance is about 70% providing the other fibers are sufficiently FR in nature not to detract on overall FR properties of the fabric. Increasing the number of plies from one to two to three increases the abrasion resistance when

TABLE 1

| Test No. | FR Rank | AR Rank | AR Factor | Wt. | Warp | Fill |
|---|---|---|---|---|---|---|
| 1 | II | 1 | 77 | 8.3 | 60 0/20 K/20 A 2/36 | same blend 3/36 |
| 2 | II | 2 | 60 | 7.1 | 40 0/20 P/20 W/20 K 2/36 | same |
| 3 | II | 3 | 66 | 7.4 | 60 0/20 K/20 A 2/36 | same |
| 4 | III | 4 | 66 | 7.2 | 60 0/40 A 2/36 | same |
| 5 | III | 5 | 65 | 8.9 | 60 0/40 A 2/36 | same blend 3/36 |
| 6 | I | 6 | 61 | 7.8 | 1/36 90 0/10 PBI plied with 1.20 | same |
| 7 | III | 7 | 60 | 7.7 | 60 0/10 P/15 VC/15 A 2/36 | (a) 66 0/18 A/10 PE/6 VC 2<br>(b) 60 0/20 K/20 A 2/36 |
| 8 | III | 8 | 50 | 8.4 | 70 0/30 A 3/36 | 70 0/30 A 3/36 |
| 9 | III | 9 | 57 | 7.3 | 66 0/18 A/10 PE/6 VC 2/36 | same |
| 10 | III | 10 | 56 | 8.1 | 70 0/30 A 2/36 | same blend 3/36 |
| 11 | III | 11 | 53 | 9.1 | 2/36 90 0/10 A plied with 1/20 A | same |
| 12 | III | 12 | 49 | 7.1 | 70 0/30 A 2/36 | same |
| 13 | III | 13 | 47 | 7.4 | 70 0/30 A 2/36 | (a) 40 0/30 A PVC 2/36<br>(b) 70/30 2/36 |
| 14 | III | 14 | 46 | 6.7 | 60 0/10 P/15 VC/15 A | (a) complex thermoplastic 2/32<br>(b) 60 0/40 A 2/36 |
| 15 | I | 15 | 45 | 11.7 | 60 0/15 VC/15 A/10 P 2/10 | same |
| 16 | III | 16 | 45 | 7.8 | 60 0/10 FV/10 PE/5 VC/15 A 2/36 | same |
| 17 | III | 17 | 44 | 7.9 | 60 0/10 FV/10 PE/5 VC/15 A 2/36 | P210 2/36 |
| 18 | III | 18 | 44 | 7.2 | 60 0/10 P/15 VC/15 A 2/36 | same |
| 19 | III | 19 | 44 | 7.7 | 70 0/30 A 2/36 | (a) 70 0/30 A 2/36<br>(b) Protex wool/PVC |
| 20 | III | 20 | 43 | 5.0 | 70 0/30 A 2/36 | 70 0/30 A 1/36 |
| 21 | — | 21 | 43 | 8.5 | 90 0/10 A 3/36 | same |
| 22 | III | 22 | 40 | 7.7 | 70 0/30 A 2/36 | (a) 70 0/30 A 2/36<br>(b) complex thermoplastic 2/44 |
| 23 | Best | 23 | 39 | 7.2 | 70 0/30 P 2/36 | same |
| 24 | III | 24 | 38 | 7.2 | 70 0/15 A/15 W 2/36 | same |
| 25 | — | 25 | 37 | 6.9 | 70 0/30 A 3/36 | same (plain weave) |
| 26 | — | 26 | 31 | 7.1 | 90 0/10 A 3/36 | same (plain weave) |

Table 1 demonstrates there is great variation in the weight of fabric and different weaves and yarns used, it was found that an abrasion resistance factor could be determined by dividing the number of rubs on the Stoll abrasion tester by the fabric weight per square yard. This factor was very consistent, reproducible and appears to make sense. It has enabled a comparison across weight effects are factored out (AR factor). However, plying a more abrasion resistant yarn such as 100% PBI with a high OPF yarn (90/10 PBI) was not nearly as effective for abrasion resistance (net 68% PBI) as intimately blending in the PBI to obtain a 30% PBI. This strongly supports the use of plied similar blended yarns. Another disadvantage is that the yarn behaves in an unbalanced manner and hurts the appearance and texture of the fabric.

All fabrics were tested according to Federal Method No. 5903 and No. 5905. All the OPF containing fabrics had either no after flame or less than one second. (Nomex has about 2.5 seconds after flame and shrinks and cracks.) The OPF fabrics with OPF contents of 65% or greater did not show significant shrinking and or serious cracking. The char lengths were from nearly zero to about 2.5 inches (Nomex was about 2.5 inches). The fabrics fell into three classification groups, I (best), II (very good), and III (good) and are rated accordingly.

The FR properties did fall somewhat with the addition of other fibers but these properties were significantly better than Nomex.

What is claimed is:

1. An abrasion and fire resistant permanent press fabric or fabric structure comprising a batting or yarn consisting of an intimate blend of oxidized polyacrylonitrile and at least two fibers selected from the group consisting of polyvinyl halide, polybenzimidazole, p-aramid, m-aramid, fire resistant polyester and fire resistant rayon, said oxidized polyacrylonitrile comprising about 25 to 85% by weight of said yarn and p-aramid comprises less than 35% by weight of said yarn or batting.

2. The fabric or fabric structure of claim 1 including fire resistant wool.

3. The fabric or fabric structure of claim 1 comprising about 30–75% by weight oxidized polyacrylonitrile, about 0–35% by weight p-aramid, about 10–35% by weight m-aramid, about 10–35% by weight polybenzimidazole, and 5–25% by weight polyvinyl chloride.

4. The fabric or fabric structure of claim 3 including fire resistant wool.

5. The fabric or fabric structure of claim 1 comprising 30–75% by weight oxidized polyacrylonitrile, 15–35% by weight m-aramid, 10–25% by weight polyvinyl chloride, 10–35% by weight polybenzimidazole and 10–35% by weight fire resistance wool.

6. The fabric or fabric structure of claim 1 comprising about 67% by weight oxidized polyacrylonitrile fiber, and 13% by weight fire resistant polyester and about 20% by weight of aramid fibers.

7. The fabric or fabric structure of claim 1 which is woven.

8. The fabric or fabric structure of claim 1 which is non-woven.

9. The fabric or fabric structure of claim 1 which is clothing.

* * * * *

UNITED STATES PATENT AND TRADEMARK OFFICE

CERTIFICATE OF CORRECTION

PATENT NO. : 4,865,906

DATED : September 12, 1989

INVENTOR(S) : W. Novis Smith, Jr.

It is certified that error appears in the above-identified patent and that said Letters Patent is hereby corrected as shown below:

In the title of the patent, change "YARD" to --YARN--.

Signed and Sealed this

Sixteenth Day of October, 1990

*Attest:*

HARRY F. MANBECK, JR.

*Attesting Officer*

*Commissioner of Patents and Trademarks*